US005082271A

United States Patent [19]

Mohr

[11] Patent Number: 5,082,271

[45] Date of Patent: Jan. 21, 1992

[54] PROCEDURE FOR THE BREAKING UP OF A STACK FORMED FROM MATERIAL IN SHEET FORM AND DEVICE FOR THE IMPLEMENTATION OF THE PROCEDURE

[76] Inventor: Wolfgang Mohr, Hundshager Weg 42, D-6238 Hofheim/Taunus, Fed. Rep. of Germany

[21] Appl. No.: 592,238

[22] Filed: Oct. 3, 1990

[30] Foreign Application Priority Data

Oct. 7, 1989 [DE] Fed. Rep. of Germany ..... 3933625

[51] Int. Cl.[5] ..... B65H 1/00

[52] U.S. Cl. ..... 271/161

[58] Field of Search ..... 271/161

[56] References Cited

U.S. PATENT DOCUMENTS

| | | | |
|---|---|---|---|
| 802,679 | 10/1905 | Brintnall | 271/161 |
| 1,147,482 | 7/1915 | Cheshire | 271/161 |
| 2,991,075 | 7/1961 | Wheeler et al. | 271/161 |
| 3,720,407 | 3/1973 | Woodward | 271/161 |
| 4,349,186 | 9/1982 | Nakamura | 271/161 |
| 4,482,146 | 11/1984 | Hoorn | 271/161 |

FOREIGN PATENT DOCUMENTS

| | | | |
|---|---|---|---|
| 123210 | 9/1901 | Fed. Rep. of Germany . | |
| 576716 | 5/1933 | Fed. Rep. of Germany . | |
| 2639677 | 1/1986 | Fed. Rep. of Germany . | |
| 119641 | 9/1980 | Japan | 271/161 |
| 1003975 | 3/1983 | U.S.S.R. | 271/161 |
| 1003976 | 3/1983 | U.S.S.R. | 271/161 |

*Primary Examiner*—Robert P. Olszewski
*Assistant Examiner*—Steven M. Reiss
*Attorney, Agent, or Firm*—Robert P. Simpson; Michael L. Dunn; Howard M. Ellis

[57] ABSTRACT

A procedure for the breaking up of a stack formed from material in sheet form, in which the stack, which rests on a support, is bent out of the initial plane formed by the position of the support, a pressure element is applied to the stack, on that side of the latter which faces away from the support, at least in the area of one end face of the stack and, with the pressure element acting, the support is moved in the direction of the initial plane. The invention also relates to a device for the implementation of the procedure.

15 Claims, 9 Drawing Sheets

Figure 1:
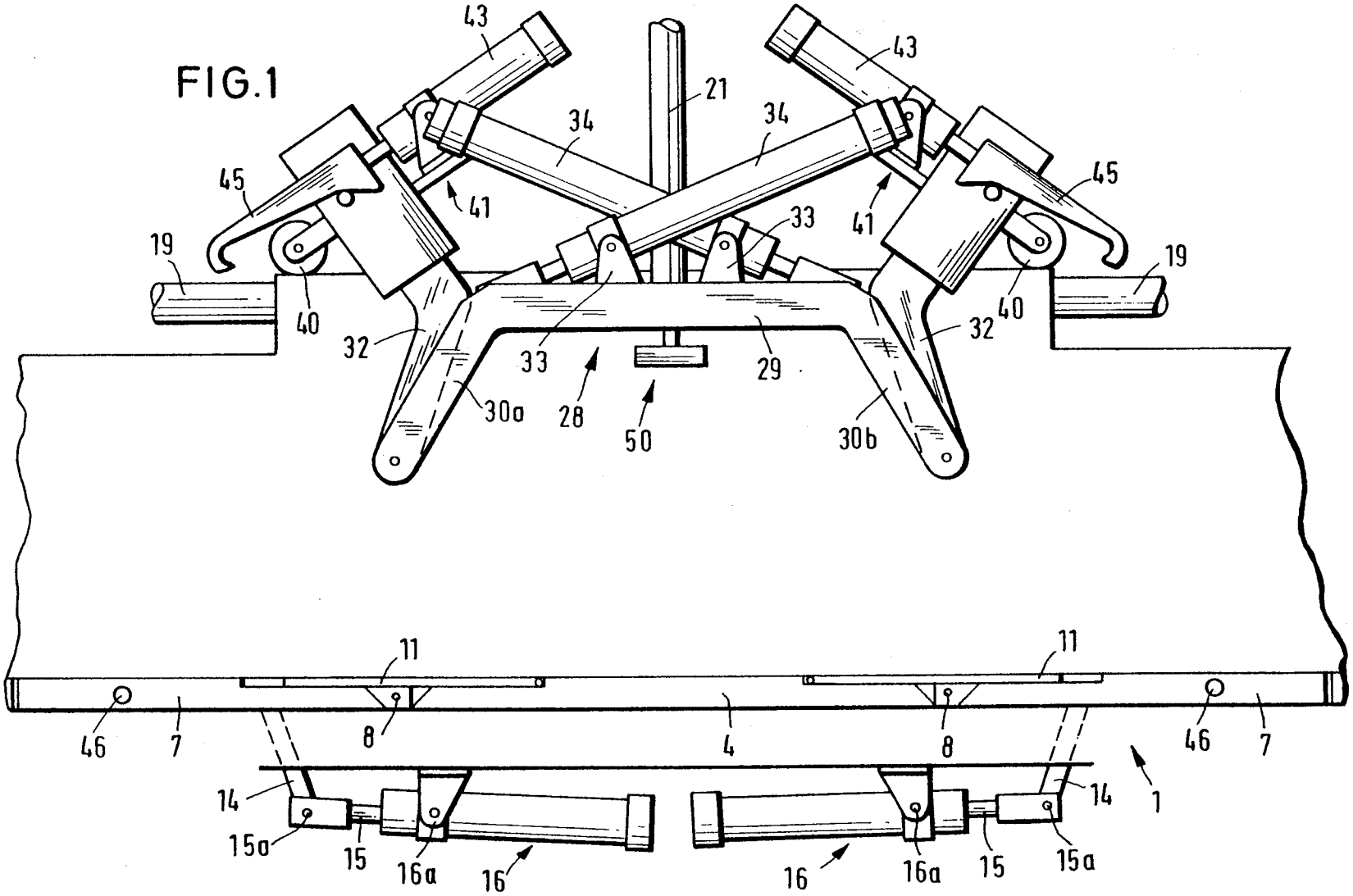

PROCEDURE FOR THE BREAKING UP OF A STACK FORMED FROM MATERIAL IN SHEET FORM AND DEVICE FOR THE IMPLEMENTATION OF THE PROCEDURE

The invention relates to a procedure for the breaking up of a stack formed from material in sheet form and a device for the implementation of the procedure. The term "breaking up" is in this connection to be understood as the separating of the individual sheet plies which adhere to one another as a result of, for example, atmospheric pressure, electrostatic charging, adhesion as a result of colour application etc.

Before the cutting of material in sheet form, it is in general necessary to align the individual sheet plies accurately at the edges in a vibrating table. It is a prerequisite for this that the stack to be vibrated is broken up and the individual sheet plies can consequently be displaced relative to one another. The breaking up is in general carried out by deforming the sheet stack from a plane shape into an arched shape, which leads to a relative movement of the individual sheet plies. The effectiveness of the breaking up can be increased additionally by means of introduction of air between the individual sheet plies.

From DE-OS 27 23 162, it is known to remove a part stack from a general stack and move it to the vibrating table by means of grippers. During this transport, a pivoting movement towards one another takes place of the grippers holding the stack on the oustide, which causes the said transfer of the stack from the plane into the arched shape. The transfer and breaking up of the material in sheet form by means of a gripper arrangement has the disadvantage that high gripper forces have to be exerted on the stack for the secure gripping of the latter and the danger thus exists that the sheet plies of the stack are damaged. It is to be taken into consideration in this connection that the stack can have a considerable weight, which is to be seen in direct association with the gripper forces to be applied. From DE-OS 26 49 959, it is known to draw by means of grippers the part stack removed from a general stack through an advance which is of plane design at its feed end and from there continuously changes over into the delivery end which faces towards the vibrating table, is shaped in the form of a section of a circular arc and is upwardly open. In the case of such a design of the advance, it is disadvantageous that the stack is not broken up in its central areas. From DE-AS 19 51 887, it is lastly known to draw the stack by means of a gripping pliers over an upwardly arched guide support. In this case also, the disadvantage is that no breaking up of the stack in the central area takes place.

The aim of the present invention is to indicate a procedure, by means of which a surface breaking up of the stack formed from material in sheet form is possible. Material in sheet form is in this connection to be understood primarily as paper, cardboard, plastic film or the like, which may be printed or unprinted. It is also the aim of the invention to indicate a device by means of which, using structurally simple means, the breaking up is possible.

The procedure according to the invention for the breaking up of the stack formed from material in sheet form is characterized in that the stack, which rests on a support, is bent out of the initial plane formed by the position of the support, a pressure element is applied to the stack, on that side of the latter which faces away from the support, at least in the area of one end face of the stack and, with the pressure element acting, the support is moved in the direction of the initial plane.

Essential in the present procedure is the interaction of the pressure element with the stack while the latter performs the bending movement. By means of the action of the pressure element during the said movement, the individual sheet plies are separated from one another. In this connection, different breaking-up processes can be achieved. It is thus in principle sufficient to provide a flexible support, which is bent as a whole, for the stack, by means of which the stack undergoes a convex concave or arching. In principle, the pressure element can already be lowered onto the stack during the transfer of the stack from the initial plane into the convex or concave position, but it is also possible only to lower the pressure element when the stack has already assumed its convex or concave shape. It is not necessary that the stack assumes a horizontal initial plane, but this is deemed advantageous as the stack can be transferred particularly easily from the preceding processing station into the breaking-up station.

A particular embodiment of the procedure according to the invention is characterized by a support, to receive the stack, which is designed as a table, the table having at least in the area of one end a table part which can be folded up out of the horizontal table plane, the stack being folded up out of the table plane in the area of the table part, the pressure element being applied to the folded up edge area of the stack and, with the pressure element acting, the table part being folded back in the direction of the table plane. In this manner, the relative displacement of the individual sheet plies of the stack takes place during the folding up of the edge area of the stack. When the edge area is folded up, the pressure element is lowered onto the stack and, with the pressure element acting, the table part is folded back in the direction of the table plane, in which connection it is not necessary that the pressure element acts upon the stack until the table part is transferred into the table plane. The latter is, however, considered advantageous. As a function of an action or otherwise of a lack of action on that area of the stack which faces away from the table part which can be folded up, different breaking-up processes can be achieved. It is thus sufficient for the production of the effect according to the invention if only one end of the table is provided with a table part which can be folded up. After the folding up of this table part and the application of the pressure element to the stack, the lowering of the table part, with the pressure element acting, leads to the stack having its individual plies displaced in relation to one another in an imbricate manner and, therefore, the stack is broken up. In this connection, it is not imperatively necessary that that end of the table which faces away from the table part which can be folded up be provided with a stop for the stack in order to prevent the stack sliding away from the table part which can be folded up when the latter is raised. Such an arrangement will not be necessary precisely because, as a result of the sheets sticking together, the stack is usually a block which is partially broken up only by means of raising the table part which can be folded up and, apart from this, as a result of the own weight of the stack, no displacement takes place in general when the table part is folded up.

It is considered preferable if the table has, in the area of ends lying opposite one another, table parts which can be folded up out of the table plane, the stack is folded up out of the table plane in the area of the table parts, pressure elements are applied to the folded up edge areas lying opposite one another of the stack and the table parts are folded back in the direction of the table plane, at least the folding back of the table part assigned to one edge area of the stack taking place with the pressure element acting upon the relevant stack section. It is thus started out from two table parts which can be folded up and which move the stack out of the table plane in edge areas lying opposite one another, which has the advantage that breaking up of the stack takes place in both edge areas and additionally the table parts, which are moved in opposite directions, counteract a displacement of the stack during the folding up of the table parts. In the case of the use of two table parts there are also, in the operational sequence, different possibilities for the action on the stack by means of one pressure element assigned to one edge area of the stack or pressure elements assigned to each edge area. It is thus envisaged, for example, only to act upon one edge area of the stack by means of one pressure element. This leads to the previously described displacement of the individual sheet plies of the stack which, after the folding back of the table parts, is essentially in the form of a parallelogram. There is also the possibility that the folding back of both table parts into the table plane takes place with pressure elements acting, and in particular that the folding back takes place simultaneously. Such action of the pressure elements leads to the upper sheet plies being drawn tight in a less arched curve between the pressure elements than the lower sheet plies and the sheet plies thus have an increased tendency to separate from one another.

As far as the two simultaneously acting pressure elements are concerned, the forces introduced into the stack via these assume increased significance. The pressure force of the respective pressure element acting upon the stack is thus to be calculated in such a manner that the sheet plies facing towards it can slide under it before the tearing strength of the respective sheet is reached.

In order to arrive at an optimum breaking-up result, the respective table part is to be capable of being folded up out of the table plane by an angle of 30° to 70°, preferably 45° to 60°. Furthermore, it is considered advantageous if the respective pressure element acts upon the stack in the area of a narrow side of the latter and, during action, blown air is blown between the sheets in the area of the longitudinal sides of the stack.

A preferred device for the implementation of the described procedure is characterized by a table with two table parts which are pivotable, by means of first power means, about pivoting axes arranged parallel to one another in the area of table ends lying opposite one another, and pressure elements which are arranged above the table parts and, by means of second power means, can be advanced in the direction of the table parts. The device expediently has a vertically movable portal frame which accommodates two bearers, which are pivotable by means of the second power means, for the pressure element mounted in the respective bearer, and which is provided with third power means which are mounted in the respective bearer and which accommodate holding hooks which can be brought into work connection with holding noses or the like which are provided in the folding table parts.

The two table parts are expediently to accommodate between them a central table part. A particular embodiment envisages in this connection that a bridge segment, which partially covers the respective pivotable table part and the central table part and is pivotably mounted parallel to the pivoting axis of the pivotable table part in the latter or the central table part, is assigned to each pivotable table part. The interaction of central table part, the two table parts which can be folded up and the bridge segments which are assigned to these and can also be folded up makes it possible to approximate the shape of the table, when the table parts are folded up, to an extensively uniformly arched shape, which as described above is in principle to be aimed for, in order to achieve a uniform arching of the stack and thus maximum relative movement of the individual sheets to one another. In this respect, further bridge segments can be provided, for example between the bridge segments and the central table part, which further approximate the multi-edged shape of the table to an arched table shape or support.

The power means for actuation of the table parts, of the pressure elements and of the holding hooks are advantageously designed as pneumatic or hydraulic cylinders.

A particular embodiment of the invention envisages that the pressure elements are designed as rotatable rollers which in particular extend over the entire length of the narrow side of the table or of the support. The pressure elements are to be provided with brake devices, in particular with brake devices which are adjustable in relation to the braking moment. The braking moment of the rollers is to be calculated in such a manner that these roll off before the tearing limit of the respective sheet is reached. The introduction of the braking moments can take place, for example, by means of disk springs which are adjustable in their pretension and which act upon the rollers in the area of the bearings of the latter.

According to a particular embodiment of the invention it is lastly envisaged that the device is mounted movably in a chassis. The possibility is thus afforded of positioning the vibrating table in close proximity to the general stack, from which the stack to be broken up is to be removed; the device mounted in the chassis is, after the separation of the stack from the general stack, moved in between these, a gripper arrangement can then deposit the stack on the table, during the movement of the table to the vibrating table the breaking up of the stack is carried out, when a position of the table above the vibrating table is reached, said gripper arrangement or another gripper arrangement takes hold of the broken up stack, the table or the device moves again in the direction of the general stack, whereupon the broken up stack is deposited on the vibrating table etc.

Further features of the invention are illustrated in the description of the Figures and in the subclaims, in which connection it is remarked that all individual features and all combinations of individual features are essential to the invention.

In the Figures, a device for the implementation of the procedure is illustrated by way of example without being restricted to this.

Figure 2:
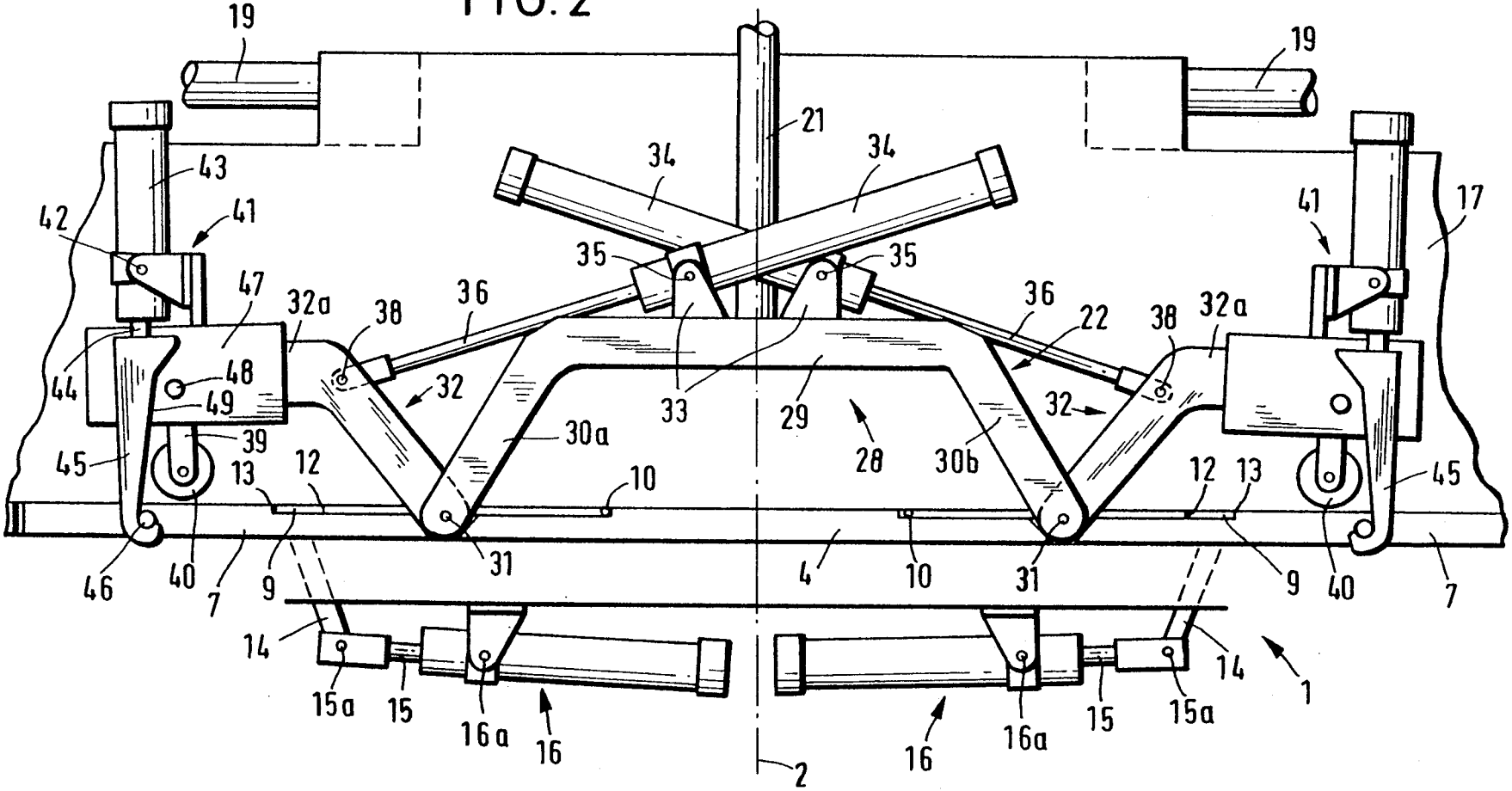
Figure 3:
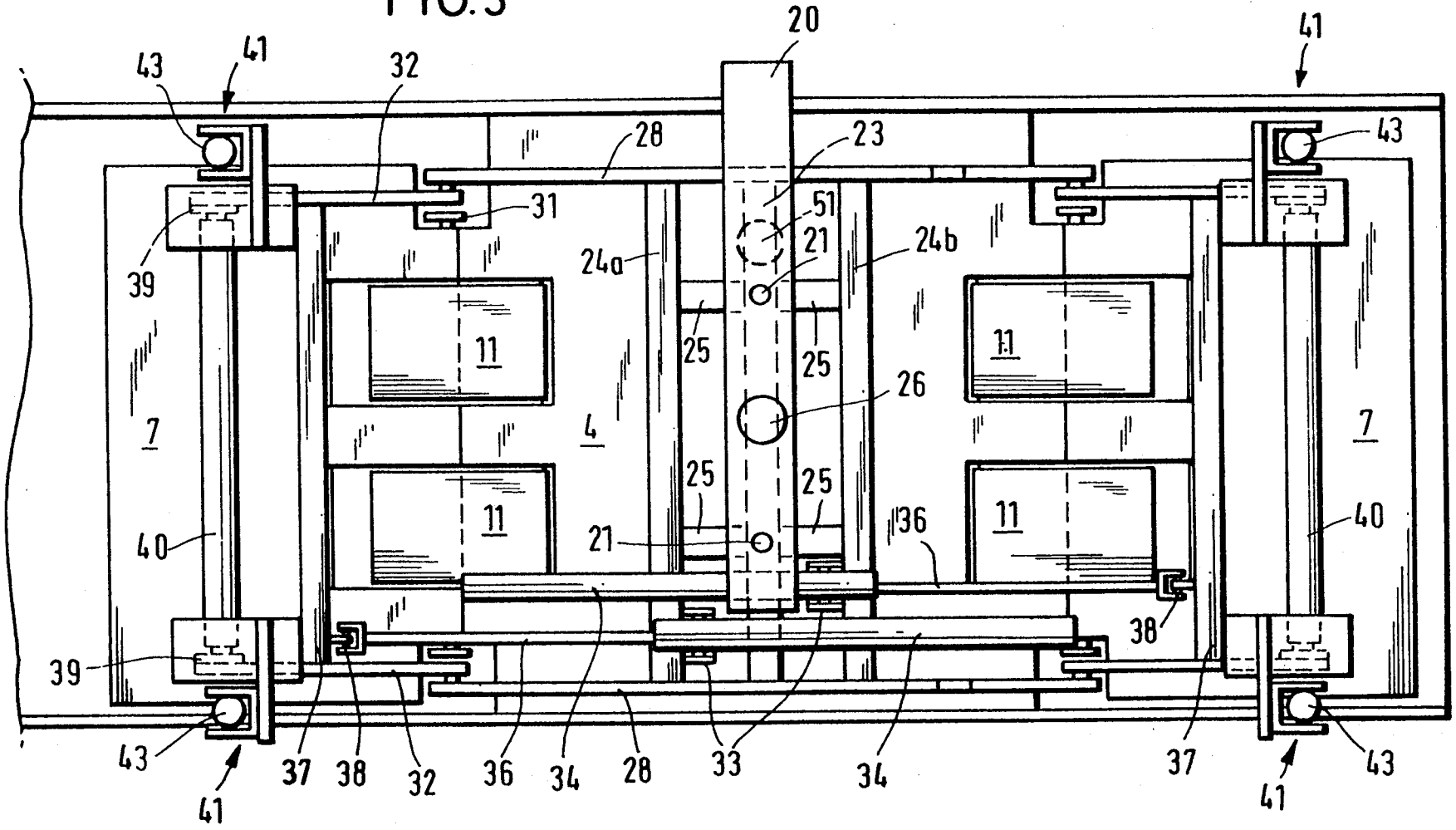
Figure 4:
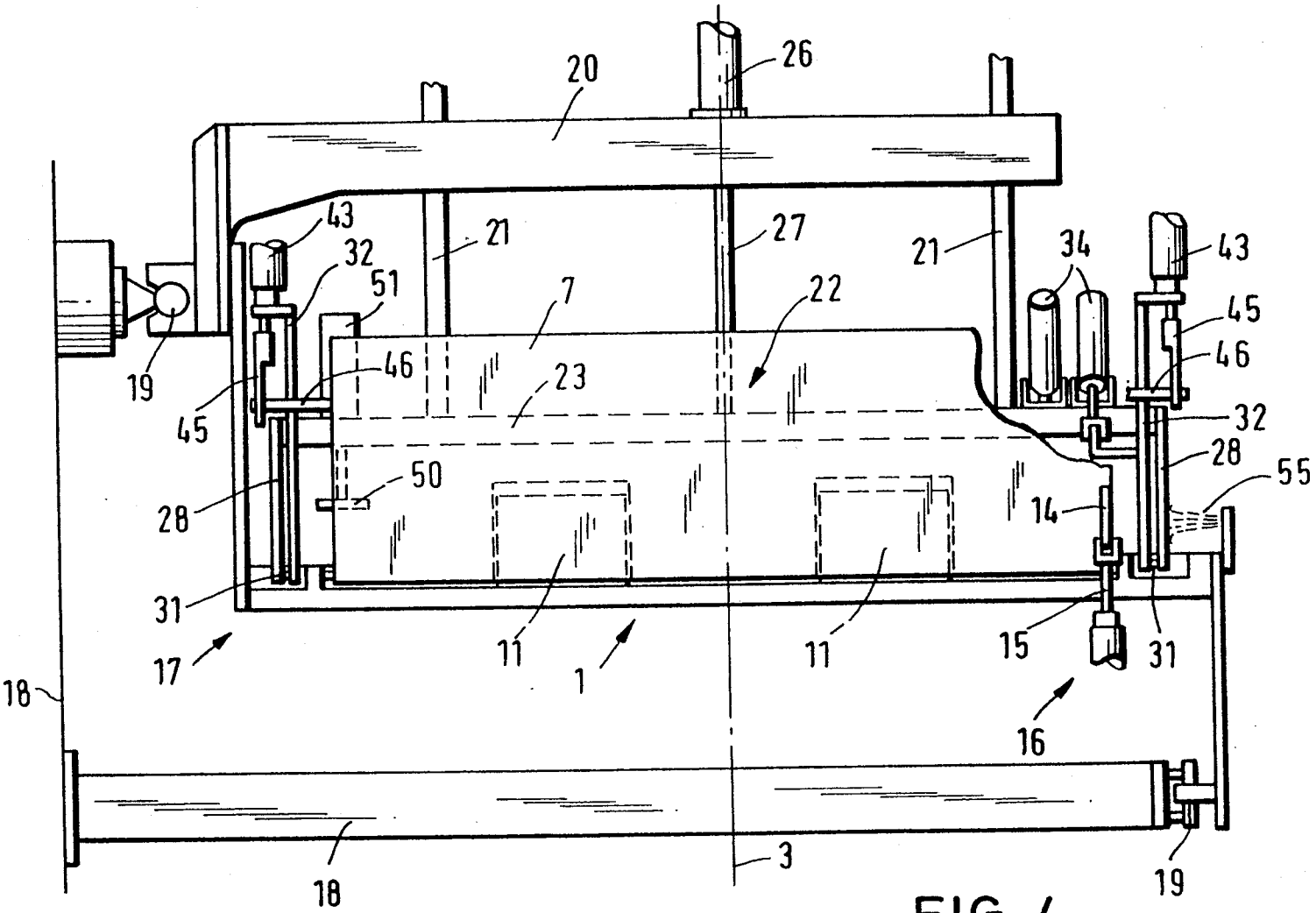
Figure 5:
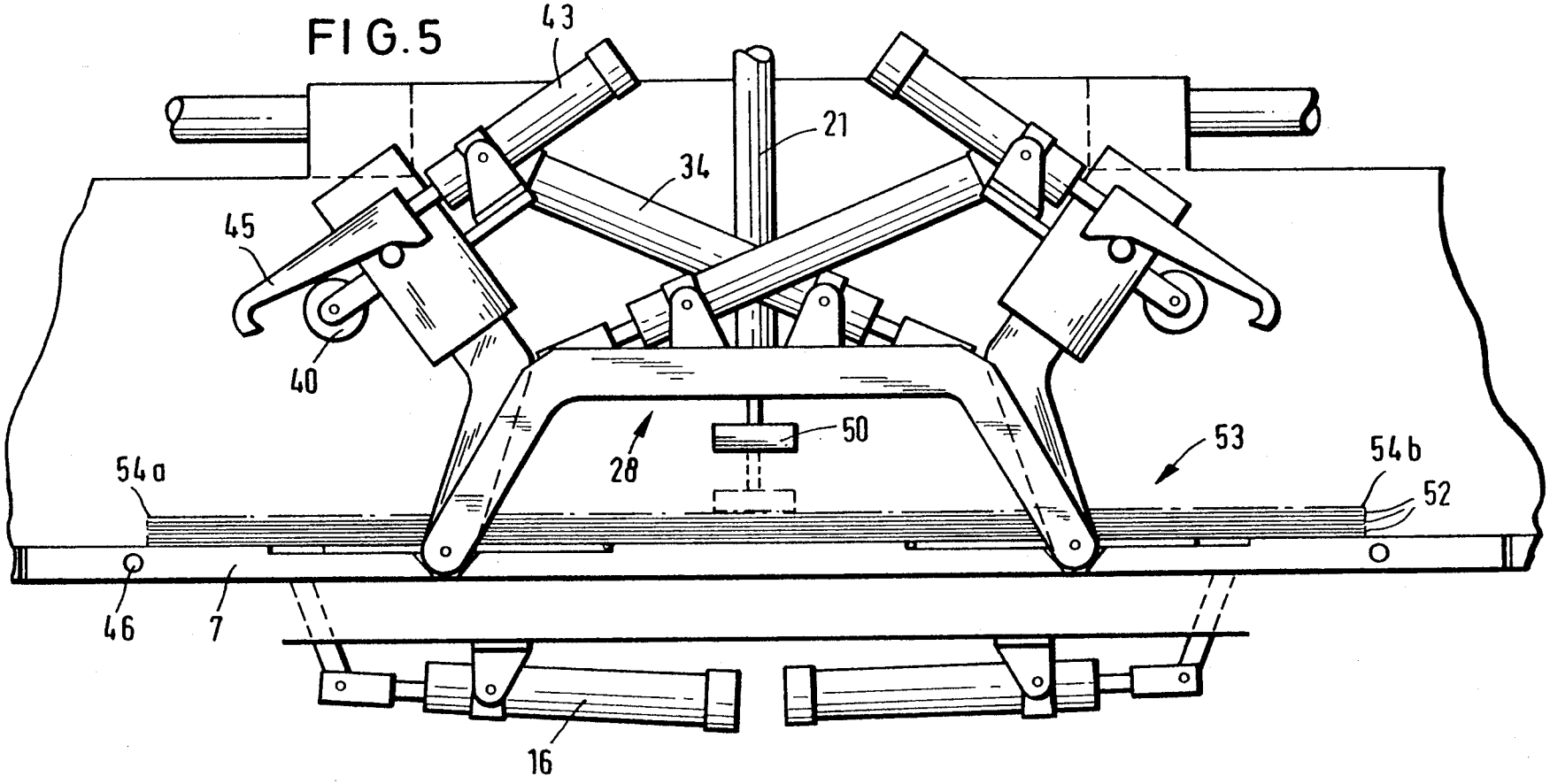
Figure 6:
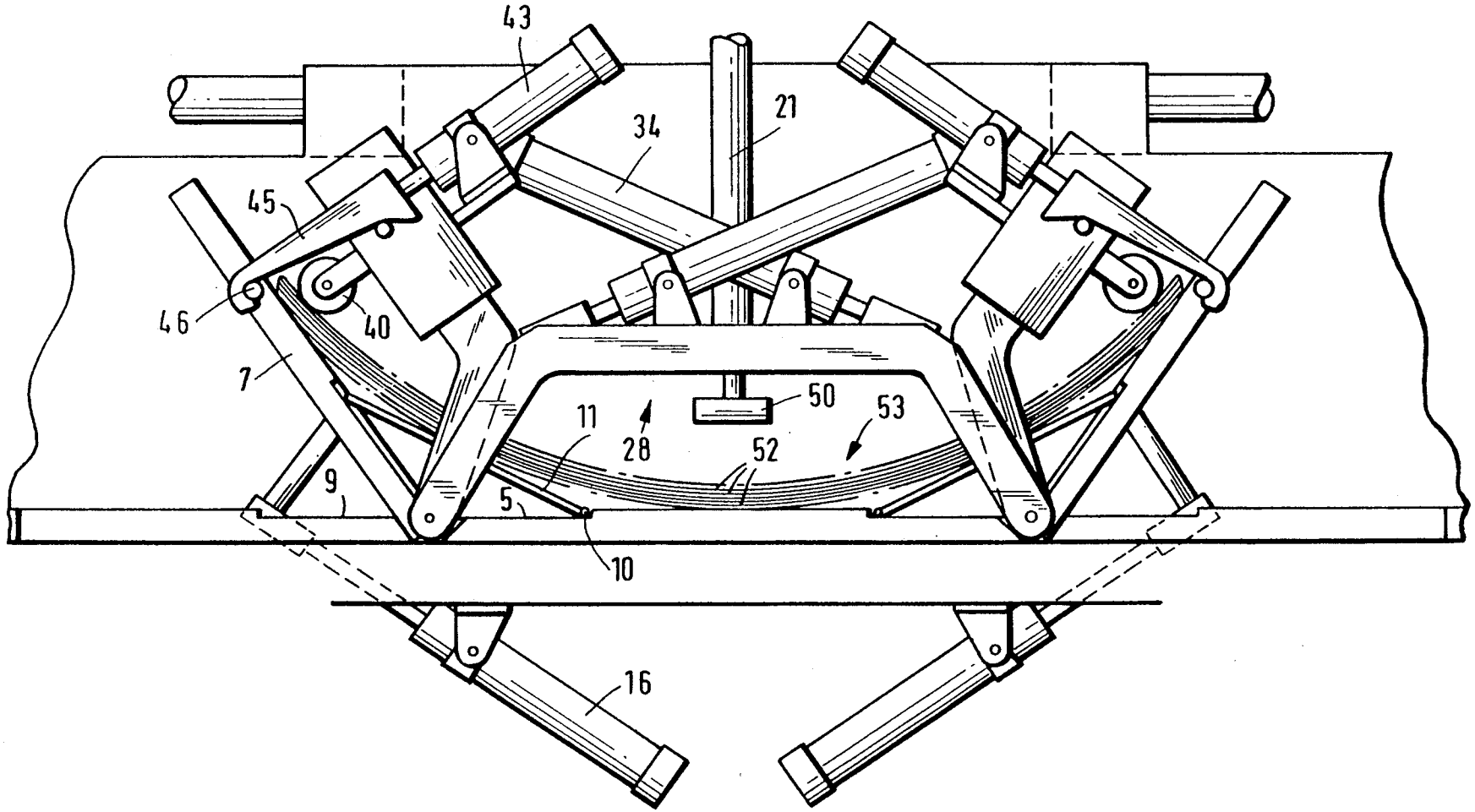
Figure 7:
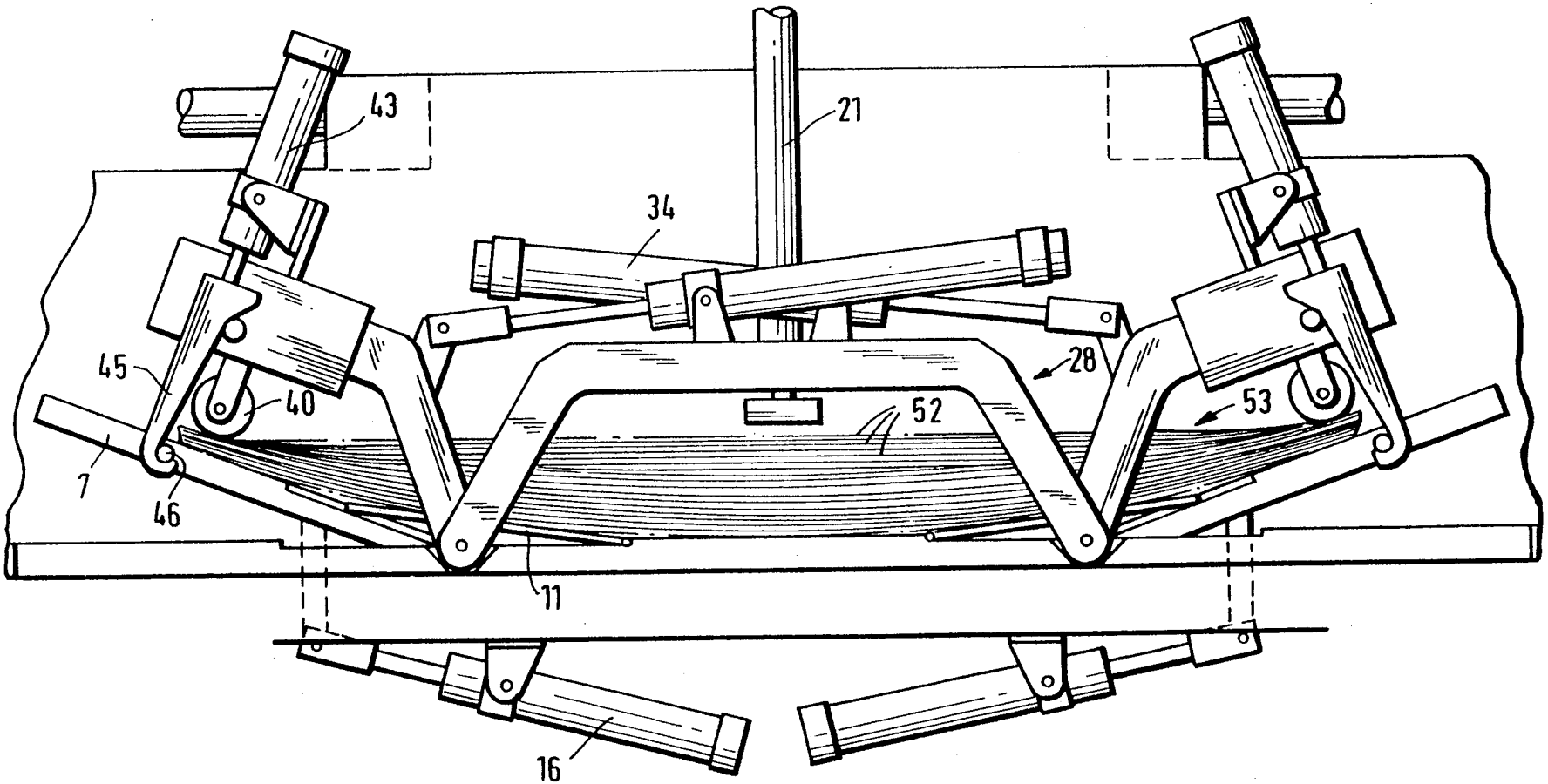
Figure 8:
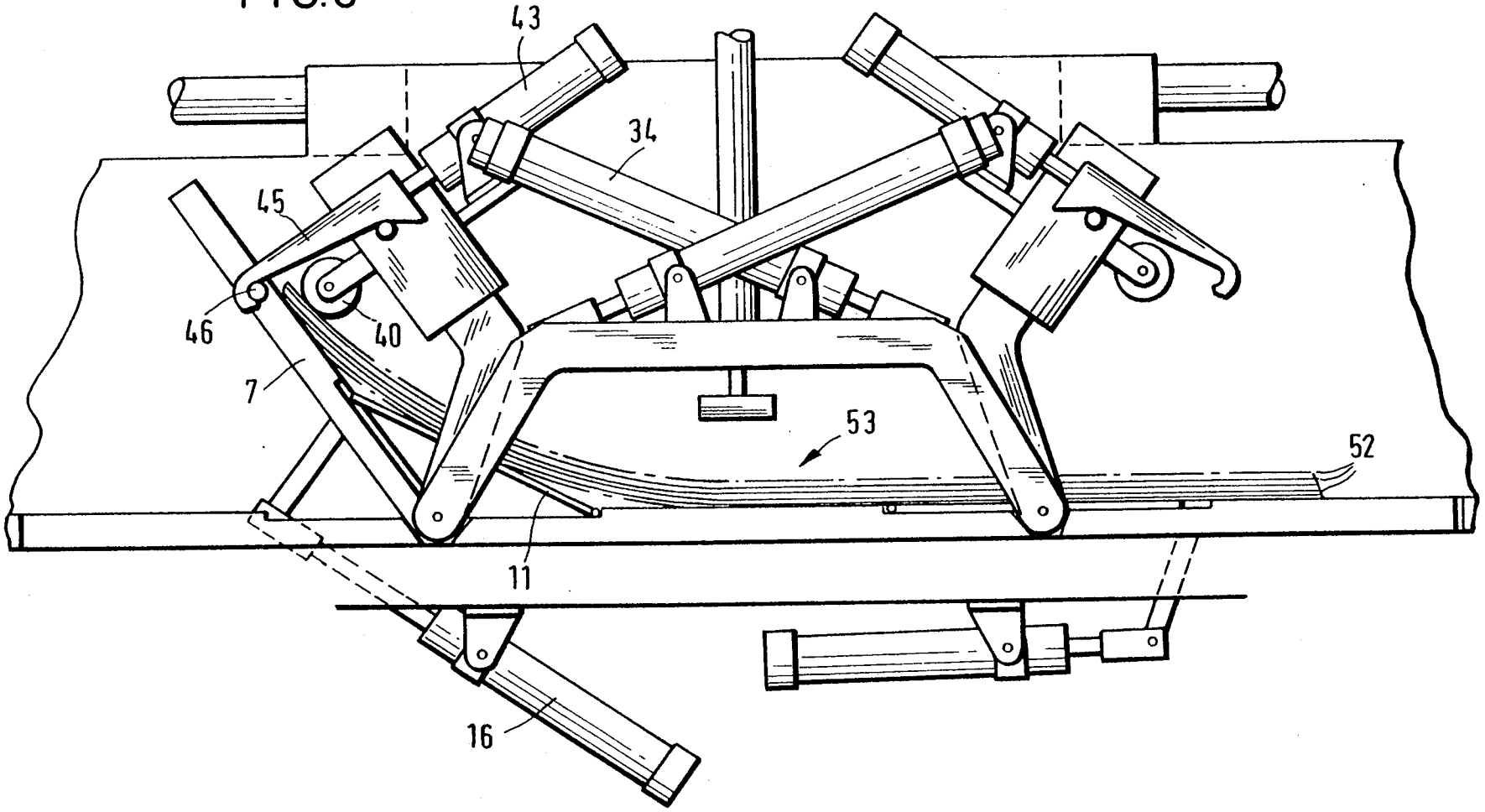
Figure 9:
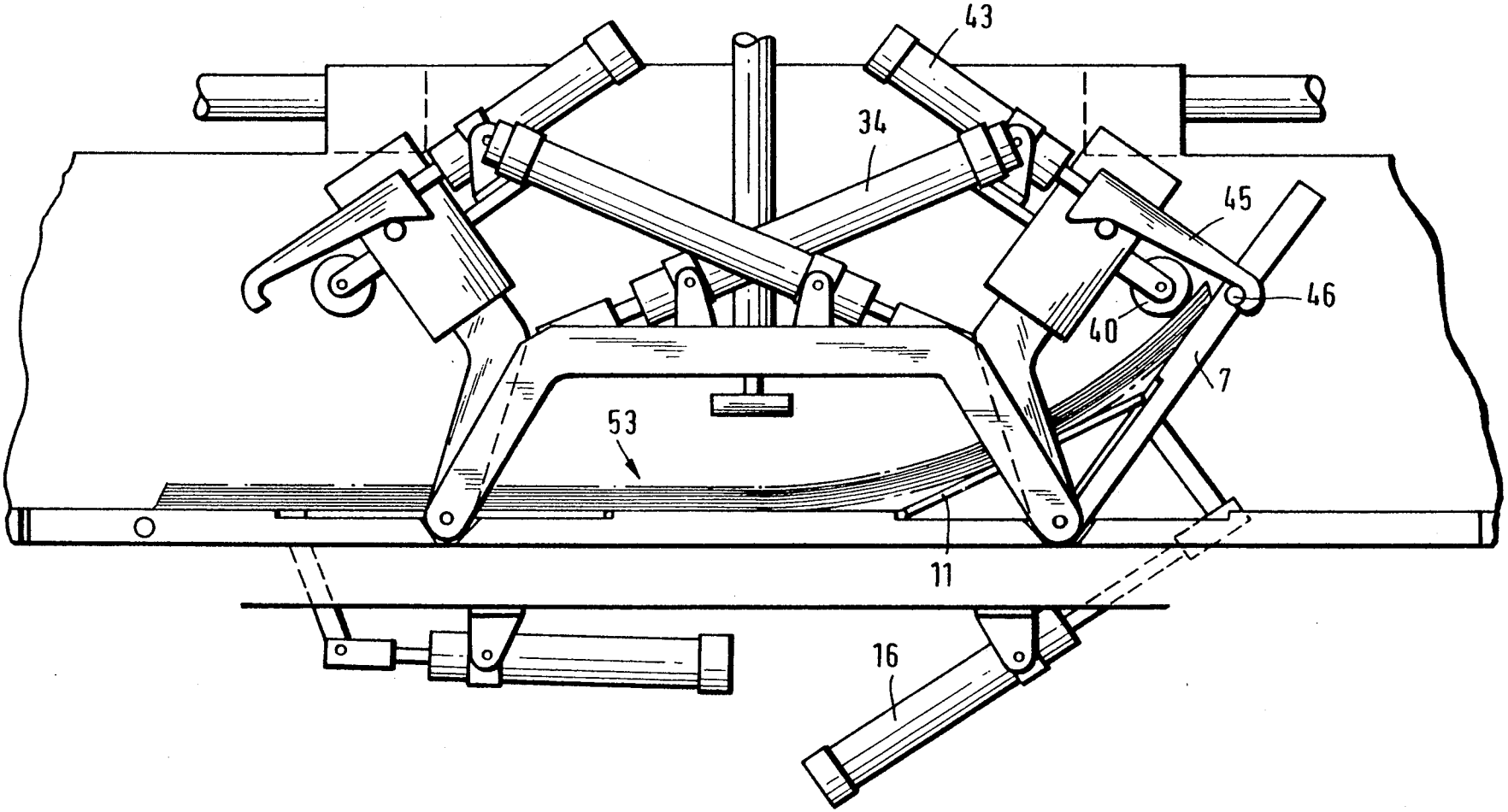

FIG. 1 shows the device for the breaking up of a stack formed from material in sheet form, illustrated in a side view with table parts not pivoted out, without a sheet stack resting on the table and with raised portal frame and pivoting frame pivoted up, FIG. 2 shows a view according to FIG. 1, with lowered portal frame and pivoting frame pivoted down with pressure elements lowered onto the table surface, FIG. 3 shows a top view of the device shown in FIG. 2, FIG. 4 shows a front view of the device with lowered portal frame and table parts pivoted out but, for graphic reasons, without illustration of the pressure elements, FIG. 5 shows a view according to FIG. 1, but with a sheet stack resting on the table, with lowered portal frame and pivoting frame pivoted up, FIG. 6 shows a view according to FIG. 5, but with raised table parts and pressure elements acting upon the stack surface, FIG. 7 shows a view according to FIG. 6, but with partially lowered table parts and pressure elements acting, FIG. 8 shows a view according to FIG. 6, with one table part folded up and one folded in and a pressure element acting upon the stack area assigned to the table part which is folded up, and FIG. 9 shows a view according to FIG. 8 but with the positions of the table parts and of the pressure elements interchanged.

FIGS. 1 to 4 serve to explain the basic structure of the device according to the invention, FIGS. 5 to 9 illustrate the procedure, which can be implemented by means of the device, for the breaking up of material in sheet form in the form of a stack.

FIGS. 1 to 4 show a table 1 which in relation to the planes 2 or 3, which run perpendicularly to the sheet planes, is constructed symmetrically. It has a central table part 4 and two table parts 7 which adjoin directly end faces of the central table 4, which lie opposite one another in the longitudinal direction of the table 1, and which are pivotable about axes 8. The central table part is in each case, adjacent to the table parts 7 in the area of its support surface, that is to say on top, provided with a recess 5, and the respective table part is likewise provided with a recess 9 (see FIG. 6) on the top and adjacent to the central table part 4. The respective recess 5 extends in this connection over approximately $\frac{1}{4}$ of the length of the central table part and the respective recess 9 over approximately $\frac{1}{3}$ of the length of the respective pivotable table part 7. In the transition from the central table part 4 to the recess 5, the respective recess 5 has a bridge segment 11 which is pivotable about an axis 10. The thickness of the table parts 7 and of the bridge segments 11 as well as the dimensions of the recesses 5 and 9 are calculated in such a manner that, with table parts 7 pivoted in and thus bridge segments 11 also pivoted in, the surface of the central table part 4 forms a plane with the upper surfaces of the table parts 7 and bridge segments 11. When the table parts 7 are folded up, the bridge segments 11 slide with their free ends 12 in the recesses 9 until, when the maximum folded out position of the table parts 7, which is pivoted out by an angle of approximately 55°, is reached, they come to lie adjacent to the undercut 13, which forms the recess 9, in the respective table part 7.

The extension of the respective retracted table part 7 amounts in each case in the longitudinal direction of the table 1 to approximately 60% of half the table length and together with the respective bridge segments 11 to approximately 80% of half the table length. The maximum pivoting range of the table parts 7 is not restricted to the concrete pivoting value of 55°; it will usually lie in an angular range of 30° to 70°, preferably 45° to 60°. The illustration of FIG. 6 in particular explains that in the folded up position of the table parts 7 and of the bridge segments 11, an almost uniformly arched curve is determined by these and the central table part 4, in which connection it of course lies within the scope of the present invention to provide a plurality of bridge segments so that, when the table parts are extended, the support contour of the table approximates a constant curve shape.

Downwardly directed pivoting arms 14, at the respective free end of which the piston rod 15 of a pneumatic cylinder 16 mounted in the table 1 engages, are connected rigidly to the table parts 7 at a distance from the axes 8. At the point 15*a*, the respective piston rod 15 is connected in an articulated manner to the pivoting arm 14, and at the point 16*a* the respective cylinder 16 in an articulated manner to the table 1.

FIG. 4 in particular explains the mounting of the table 1 in a chassis 17 which is displaceably mounted in the longitudinal direction of the table 1 in an angle stand 18. The reference numbers 19 indicate the longitudinal guides of the chassis 17 accommodating the table 1. It can also be seen from the Figure that the width of the table parts 7 extends over almost the entire width of the table 1 and that in each case two bridge segments 11, which in each case are approximately $\frac{1}{4}$ as wide as the table, are arranged next to one another.

Above the table 1, the chassis 17 has a horizontal bearer 20 which extends perpendicularly to the longitudinal guides 19 almost as far as that end of the table 1 lying opposite, above the latter, and on which, by means of vertical guides 21 which are arranged at a distance from one another, a vertically movable portal frame 22 is guided, which extends over almost the entire width of the table 1. The portal frame 22 consists essentially of a central bearer 23 arranged below the bearer 20 and two outer bearers 24*a* and 24*b* arranged at a distance from the latter, central bearer 23 and the outer bearers 24*a* and 24*b* respectively being connected to one another in each case by means of two short longitudinal bearers 25. The two guides 21, which are designed as tubes and which in each case pass through a guide bore, not shown in greater detail, in the bearer 20, are connected to the central bearer 23. A pneumatic cylinder 26, the piston rod 27 of which engages centrally between the two guides 21 on the central bearer 23, is also connected to the bearer 20.

At the ends which lie opposite of the central bearer 23 and outer bearers 24*a*, 24*b*, a bearer frame 28, which is constructed symmetrically in relation to the axis 2 and has a horizontal central section 29 as well as two leg sections 30*a* and 30*b* which are directed downwards at an angle of about 120° to the latter, is connected to the respective end. At articulations 31 in the area of the free ends of the leg sections 30*a*, 30*b*, bearers 32 are mounted, the distance between the articulations 31 of the respective bearer frame 28 corresponding to the distance between the axes 8 of the table 1. In the area of one end of the outer bearers 24*a* and 24*b*, pneumatic cylinders 34 are pivotably mounted in bearing flanges 33 about bearing points 35, the piston rod 36 of each of the two pneumatic cylinders 34 engaging in an articulated manner at a point 38 on a transverse bearer 37 which connects the two associated bearers 32. In the lowered position of the portal frame 22 according to the illustration in FIG. 2 and the pivoted out position shown there of the bearers 32, which together with the transverse bearer 37 in each case form the pivoting frame, their areas 32*a* which face away from the articulation 31 are orientated essentially horizontally.

In the area of the respective free end of the bearer areas 32*a*, these have projections 39 which are directed downwards perpendicularly to these, a pressure roller 40 being mounted in each case between two associated projections 39. This pressure roller thus extends over almost the entire width of the table 1. The pressure rollers 40 are provided with adjustable brake devices which are not shown in greater detail, for example in the form of disk springs, so that they can rotate when a defined torque is exceeded. In a bearing flange 41, which extends above the respective bearer area 32*a* and is connected to the bearer 32, a vertically orientated pneumatic cylinder 43, the downwardly directed piston rod 44 of which in each case accommodates a relieving hook 45 arranged outside the contour of the table 1, is in each case pivotably mounted about an axis 42 arranged parallel to the bearing axis 31. The respective table parts 7 are correspondingly provided on their wide sides with outwardly projecting holding pins 46. The relieving hooks 45 can, in a certain operating position with the hook opening directed towards the central table area 4, enclose the holding pins 46. Next to the respective relieving hook 45, a bearing plate 47, which has a stop pin 48 in the path of movement of the relieving hook 45, is connected to the bearer area 32*a* of the bearer 32. On the side facing towards the central table part 4, the respective relieving hook 45 has a kinked incline 49 in the direction of the piston rod 44 and directed towards the central table part 4. When the relieving hook 45 is almost fully extended, it pushes with its incline 49 against the stop pin 48 so that, when there is no engagement with the holding pin 46, the relieving hook 45 is pivoted out of the path of the holding pin 46.

Illustrated lastly in FIGS. 1 to 4 is the arrangement, eccentric in relation to the longitudinal axis of the table, of a holding-down device 50 which is vertically movable by means of a pneumatic cylinder 51 which is connected to the central bearer 23.

With reference to FIGS. 5 to 9, the method of operation of the device described thus far is explained below. Before the loading of the table 1 with a stack 53 formed from individual sheets 52, the device is in the position shown in FIG. 5, that is to say the table parts 7 and the bridge segments 11 are folded in, so that the table 1 has a plane support surface, and the bearer frame 28, with bearers 32 pivoted up, is lowered. By means of a gripper arrangement which is not shown, a stack 53 is, for example, removed from a general stack which is also not shown, and deposited on the table 1 symmetrically to the planes 2 and 3 and clamped there after lowering of the holding-down device 50. Subsequently, the gripper is moved out of the area of the table 1 again. After being placed on the table 1, the stack 53, which has been separated from the general stack and is resting on the table 1, in general forms a closed block, that is to say the individual sheets 52 cannot be displaced in relation to one another easily, which is a prerequisite for an accurate alignment at the edges of the stack in a subsequent vibrating table which is not shown in greater detail.

After the stack 53 has been placed on the table 1, the pneumatic cylinders 16 are acted upon and bring about a folding up of the table parts 7 and thus also of the bridge segments 11 into the position shown in FIG. 6. In this position, the sheet plies, going from the neutral plane 2 towards the edges 54*a* and 54*b*, are displaced to an increasing extent, so that in the area of displacement the block shape is already done away with. When the table parts 7 are folded up, the pressure rollers 40 come into contact with the stack 53 in the area of the stack edges 54*a* and 54*b* and the relieving hooks 45 engage behind the holding pins 46. By means of a defined retraction of the piston rod 44 of the pneumatic cylinders 43 on the side of the hook, a predetermined pressure force is exerted on the stack 53 via the respective pressure roller 40 (FIG. 6). At this point in time at the latest, the clamping of the stack 53 is brought to an end by means of raising of the holding-down device. If the table parts 7 and thus the bridge segments 11 are then pivoted back by means of actuation of the pneumatic cylinders 16, with the simultaneous follow-up of the pressure rollers 40 as a result of the force-locking and form-locking by means of the relieving hooks 45 and relief of the pneumatic cylinders 34, this brings about a stretching, which increases from the lower to the upper sheet plies, of the individual sheets 52 which thus separate from one another (FIG. 7). At this moment, by means of a large number of air nozzles 55 (FIG. 4) which are arranged at the side on the table 1, air is blown between the individual sheets 52. Upon the further lowering of the table parts 7 and of the bridge segments 11 with simultaneous follow-up of the pressure rollers 40, when the upper sheet plies are drawn completely tight, the set braking moment of the pressure rollers 40 is exceeded, so that these roll off outwards on the uppermost sheet 52.

As soon as the table parts 7 and the bridge segments 11 are completely folded in, the piston rods 44 of the pneumatic cylinders 34 on the side of the hook are extended, whereupon the relieving hooks 45 come out of engagement with the holding pins 46, after a corresponding pivoting movement as a result of their contact on the stop pins 48, so that the pressure rollers 40 can then be raised from the stack 53 by means of pivoting of the bearers 32 by means of the pneumatic cylinders 34. By means of the grippers which are not shown, the broken up stack 53 can then be advanced to further processing, in particular to the vibrating station. Apart from this, there is of course the possibility of repeating the breaking-up operation, as illustrated in FIGS. 5 to 7, a number of times, in certain circumstances also after prior rotation of the stack 53 on the table 1 by 90°.

In order to guarantee a complete breaking up of the stack 53, it is to be ensured that the pressure rollers 40 are always placed on the stack edges 54*a* and 54*b* as close as possible to the latter and a follow-up of the pressure rollers 40 takes place upon lowering of the table parts 7 and bridge segments 11.

FIG. 8 shows a procedural section which offers itself in particular subsequent to the breaking-up process illustrated in FIGS. 5 to 7. Subsequent to this procedural sequence, the table parts 7 and the bridge segments 11 are thus to be pivoted again into the folded out position shown in FIG. 6, in which connection, however, it is to be ensured that only the pressure roller 40 assigned to the stack edge 54*a* acts upon the stack. 53. When the table parts 7 and bridge segments 11 are folded in, in which connection the table parts 7 do not necessarily have to be lowered synchronously, the pressure roller 40 assigned to the edge 54*a* of the stack 53 fixes this stack area, so that the stack 53, when the table parts 7 and bridge segments 11 are retracted, is in the form of a parallelogram. Such a breaking up is expedient if—in relation to the illustration in FIG. 8—the stack 53 is subsequently to be vibrated abutting on the right in a vibrating station. In the event of action only by means of the right pressure roller 40, as shown in FIG. 9, an opposite shape of the stack 53 is produced, with the possibility of abutting on the left in a subsequent vibrating station.

We claim:

1. A method of breaking up a stack of sheet material which comprises the steps of:

(a) providing a stack of a material comprising sheet plies adhering to one another, said stack having a bottom end and a top end, said bottom end resting on a support station to form an initial plane for said stack, (b) moving said support station to cause said stack to bend outwardly in an arched configuration from said initial plane, (c) compressing said bent stack at least at two terminal end portions thereof with at least two pressing elements with sufficient pressure that the sheet plies in contact with said pressing elements slide under the pressing element before the tearing strength of the respective sheet ply is reached, and (d) moving said support station with said compressed bent stack back in the direction of said initial plane.

2. The method of claim 1 including the steps of moving and bending said stack outwardly from said initial plane by means of said support station and compressing opposing terminal ends of said stack with first and second pressing elements, said support station comprising first and second bending elements.

3. The method of claim 2 including the step of folding back said first and second bending elements in the direction of said initial plane consecutively.

4. The method of claim 2 including the step of folding back said first and second bending elements in the direction of said initial plane simultaneously.

5. The method of claim 2 including the step of pivoting the bending elements of said support station by an angle of about 30° to about 70°.

6. The method of claim 2 including the step of pivoting the bending elements of said support station by an angle of about 45° to about 60°.

7. The method of claim 1 including the step of providing a stack having a long side dimension and a narrow side dimension, compressing said narrow side, and blowing air between said sheet plies.

8. A device for breaking up a stack of sheet material, which comprises means for supporting said stack in an initial plane, said supporting means including means for bending said stack in a direction outwardly from said initial plane, means for engaging and compressing at least one end of said stack of sheet material after actuation of said means for bending said stack, and means for moving said stack engaging and compressing means in the direction of said means for bending said stack, said stack bending means comprising at least a pair of first and second pivoting table parts located at opposing ends of the table means and first power means for driving and pivoting table parts and said means for engaging and compressing said stack comprises a vertically movable central frame member positioned above said table parts, arm extensions pivotally mounted to said central frame member, pressure elements for exerting force against said stack of sheet material supported by said arm extensions, and second power means for driving said arm extensions.

9. The device of claim 8 including means for hooking said arm extensions and pressure elements to said table parts, said hooking means being driven by a third power means.

10. The device of claim 9 wherein said table parts pivot about spaced axes arranged parallel to one another in said table means.

11. The device of claim 10 wherein said first and second table parts comprise a primary folding table and a secondary bridging table overlapping at least a portion of said primary folding table, said tables being spaced, parallel axes.

12. The device of claim 11 wherein said power means comprises fluid motor means.

13. The device of claim 12 wherein said pressure elements comprise roller means.

14. The device of claim 12 wherein said pressure elements comprise roller means with adjustable braking means.

15. The device of claim 8 mounted on a horizontal movable chassis.

* * * * *

UNITED STATES PATENT AND TRADEMARK OFFICE

CERTIFICATE OF CORRECTION

PATENT NO. : 5,082,271

DATED : January 21, 1992

INVENTOR(S) : Wolfgang Mohr

It is certified that error appears in the above-identified patent and that said Letters Patent is hereby corrected as shown below:

Column 10, Claim 11, line 35, please delete "being" and insert in its place --having --.

Signed and Sealed this

Twentieth Day of April, 1993

*Attest:*

MICHAEL K. KIRK

*Attesting Officer*

*Acting Commissioner of Patents and Trademarks*